United States Patent [19]

Mehnert

[11] Patent Number: 4,825,839

[45] Date of Patent: May 2, 1989

[54] SUPERCHARGED INTERNAL COMBUSTION ENGINE DRIVING SYSTEM

[76] Inventor: Gunter Mehnert, Sandhauser Str. 43B, 1000 Berlin 27, Fed. Rep. of Germany

[21] Appl. No.: 117,204

[22] Filed: Nov. 20, 1987

[30] Foreign Application Priority Data

Jan. 20, 1986 [DE] Fed. Rep. of Germany ..... 3601836
Apr. 1, 1986 [DE] Fed. Rep. of Germany ..... 3611171

[51] Int. Cl.[4] ..... F02B 39/06
[52] U.S. Cl. ..... 123/561; 123/564
[58] Field of Search ..... 123/559.1, 561, 564

[56] References Cited

U.S. PATENT DOCUMENTS

| | | | |
|---|---|---|---|
| 1,732,405 | 10/1929 | Invernizzi | 123/561 |
| 1,984,013 | 12/1934 | Fast | 123/564 X |
| 2,390,626 | 12/1945 | Szekely | 123/561 |
| 2,949,902 | 8/1960 | Calovolo | 123/561 X |
| 4,188,918 | 2/1980 | Robbins | 123/561 X |

FOREIGN PATENT DOCUMENTS

| | | | |
|---|---|---|---|
| 920220 | 11/1954 | Fed. Rep. of Germany . | |
| 1945905 | 3/1971 | Fed. Rep. of Germany . | |
| 973267 | 9/1950 | France | 123/561 |
| 1013437 | 4/1952 | France | 123/561 |
| 479803 | 11/1969 | Sweden | 123/561 |
| 619978 | 3/1949 | United Kingdom | 123/561 |

*Primary Examiner*—Michael Koozo
*Attorney, Agent, or Firm*—Fleit, Jacobson, Cohn & Price

[57] ABSTRACT

A drive system especially for motor vehicles and the like, with a conventional internal combustion engine, having at least planetary gearing and a mechanism for the mechanical boosting of the engine, comprising a compressor with displacement effect, a forwardly disposed low pressure chamber and rearwardly disposed high pressure chamber, which are connected together by return-flow ducts and throttle valves. Power transmission, speed change and engine boosting are controlled in running operation by throttling the air flow, in which respect the compressor, driving by way of a system-specific distributor gear, transmits power back to the distributor gear as a reaction element and thus forcibly influences the drive torque or speed of rotation of the power take-off shaft, while on the other hand as a compressor it provides charging air, stationary low pressure in the intake-side of the low pressure chamber makes possible an autonomous cooling of the system. Return-flow ducts between the pressure chambers assist for example the idling operation. For the torque amplification, one or more mechanical step-down stages can be used, more especially with the planetary gear sets, with phasewise superimposition of the step-down stages and automatic phase change.

11 Claims, 2 Drawing Sheets

SUPERCHARGED INTERNAL COMBUSTION ENGINE DRIVING SYSTEM

FIELD OF THE INVENTION

The invention relates to drive system for systems driven by an internal combustion engine, for example for use with motor vehicles, with control and regulating members for setting and maintaining predeterminable operating states, a mechanical compressor of the displacement type, a gearing mechanism with which the driving power of the engine can be divided into two components, one of the components being transferrable to the power-take-off shaft of the driving system and the compressor being drivable by the other component, and the compressor on the one hand sucks in and compresses air for boosting the engine and on the other hand transfers power back to the gearing, and the power-take-off rotational speed is steplessly adjustable with the aid of throttle valves.

BACKGROUND OF THE INVENTION

Driving systems of this kind, more especially having the stated components, are known and have been used in practice in many variations. This applies to stepless gearing types as well as to the various methods for boosting the engine. Each of the known versions has, however, also specific disadvantages.

Stepless transmissions which have the advantage e.g. of keeping the driving torque at a maximum and keeping the fuel consumption to a minimum face the fundamental problem that a change in the speed ratio of two shafts is in principle possible only with a temporary or permanently-partial interruption of the power transmission between them. The degree of slippage upon transmission changers gives rise to specific disadvantages in the mechanical and hydraulic types of stepless transmissions in accordance with the prior art, be they defined or undefined slippage intervals of the mechanical or hydraulic type. Even pneumatic transmissions could be said to fall within this category.

Special compressed-air transmissions using displacement effect, for example for tools or for lifting appliances, are known which are driven by compressed air. They are of no use in driving systems having internal combustion engines. On the other hand, a pneumatic transmission having several propellers, a turbine and circulating air flow for power transmission is disclosed in German Offenlegungschrift No. 1,945,905. However, with undefined, permanent slippage, the efficiency and maximum transferrable torque thereof are rather poor.

A further example proposed in German Patent Specification No. 920,220 is a unit which generates compressed air for boosting the engine, with the object of increasing the throughput of air in the combustion chambers thus raising the performance and reducing the fuel consumption. The use of such units have specific disadvantages. For example, mechanical superchargers having compressors of the displacement type, directly driven by the crankshaft, utilize a relatively high proportion of the useful power. Moreover, exhaust gas superchargers, for example pressure-wave and turbo superchargers, which operate with the energy of the exhaust gas, work under considerable thermal load and are very dependent on engine speed. All the known supercharger systems have in common the fact that they consume energy and are operated independently of the power transmission. The problem of driving systems involving internal combustion engines, is one of converting the limited range of favourable engine speed to a such greater range of speed of the driving shaft, and this subject is not dealt with by the prior art proposals.

SUMMARY OF THE INVENTION

The invention is concerned with the problem of so integrating transmissions and superchargers that they supplement one another in their effect, so that the above referred to disadvantages of the known stepless types of transmission are avoided, and the driving system conceived can be more simply built and provided than prior art systems of comparable efficiency.

This problem is solved in that in front of the compressor at the engine side there is provided a high pressure chamber and at the intake side there is provided a low pressure chamber, the underpressure chamber has a throttle valve, in that the high pressure chamber and the low pressure chamber are connected in parallel by means of at least one return duct having a throttle valve, in that with the aid of a further throttle valve a part of the compressor driving moment serves to generate low pressure in the low pressure chamber and a pneumatic mechanism transmits a retroactive moment to the power-take-off shaft, in which respect this retroactive moment is proportional to the pressure difference between the pressure in the high pressure chamber and in the low pressure chamber.

As a result of the above measures an internal combustion engine driving system consisting of power transmission, speed change and air compression for boosting the engine is provided, which can also be provided with system specific cooling, in a mechanically and pneumatically acting functional unit and is steplessly controllable by means of simple throttle valves.

BRIEF DESCRIPTION OF THE DRAWINGS

Embodiments of the invention will now be described in greater detail and will be better understood when read in conjunction with the following drawings in which.

DETAILED DESCRIPTION

Figure 1:
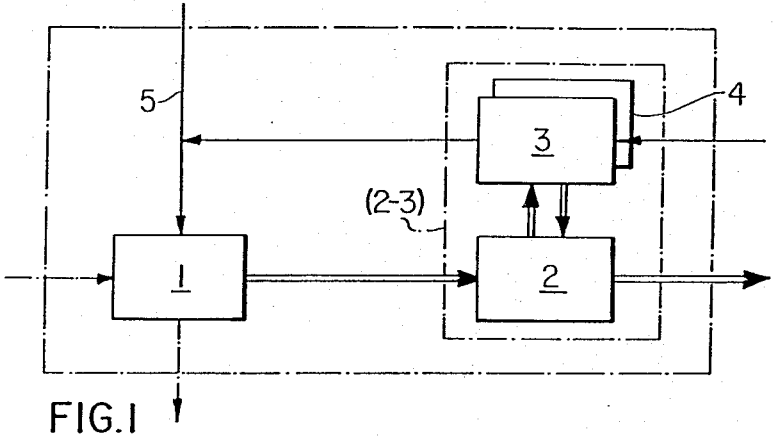
FIG. 1 is the basic structure of the drive system.

The system component shown in FIG. 1 is a conventional internal combustion engine 1 as a driving source, having fuel and air feed. In accordance with the invention, the requisite air can, depending on the structural design and use of the motor vehicle, be conveyed in various ways into the combustion chambers, namely by way of the system-specific compressor of the pneumatic mechanism 3 and only thereby or additionally, in bypass operation, by way of a suction valve 5 from the outside or additionally or solely by way of a further supercharger 4, which advantageously is driven by the transmission system 2.

Other arrangements in which the supercharging of the engine is effected by a separate device or entirely omitted also lie within the scope of the invention provided they include a partial system of the type 2-3.

Figure 2:
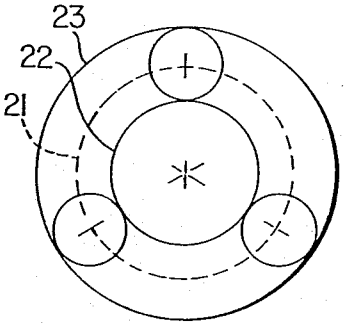
FIG. 2 is a preferred version of the system-specific transmission system in its simplest form.

The rotational energy of the crankshaft is transmitted into the system component 2. The system component 2, consisting of at least one distributor transmission, can likewise take many forms. In FIG. 2 a simple rotary gear-toothed gear system with planet gears and an internally toothed wheel are schematically illustrated.

The drive is effected in this case by way of the planet carrier 21. The planet wheels 24 thus distribute the driving power into a component which is available by way of the internally-toothed wheel 23, e.g. for the power-take-off, and into a component which acts by way of the sun wheel 22 on the device 3.

In principle, a reverse distribution of power is possible. Insofar as it is constructionally possible, it is desirable to transmit the higher number of revolutions by way of the internal central wheel 22. The kinematics of the sun and planet wheel mechanisms are well known: Let q be the (variable) ratio of the angular velocities w(22) to w(21). For each relative size of the meshing gears there is in each case exactly one ratio q* in which q*>1 where the outer wheel 23, constituting the power-take-off, stands still (idling constellation). In the case where q=1, i.e. where w(22)=w(21), the driving and power-take-off speeds are the same, i.e. there is direct transmission.

With the aid of the system component 3, this ratio q can in running operation be steplessly varied and be set to the optimum value. In this case a clutch is not necessary.

Figure 3:
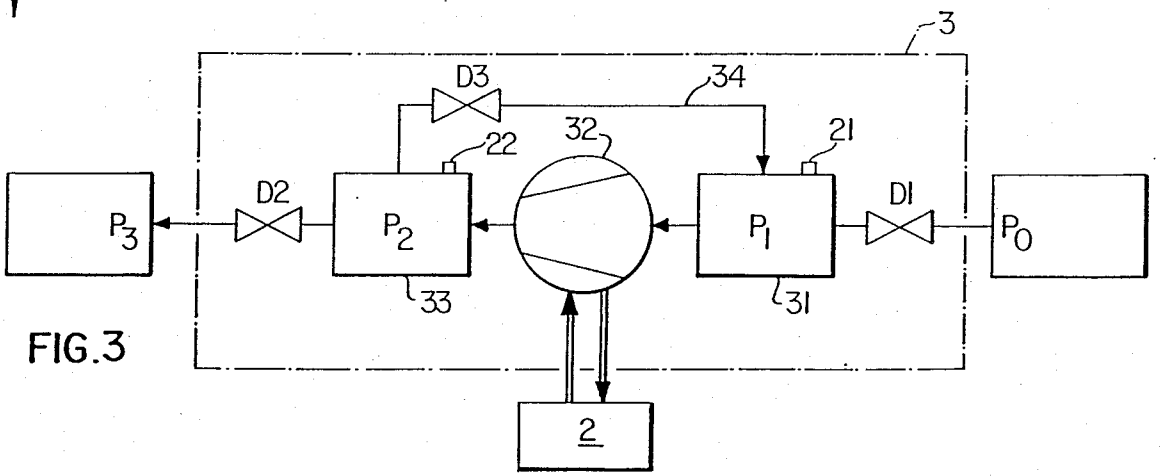
FIG. 3 is the structure of the pneumatic mechanism and the intersection thereof with the transmission system shown in FIG. 2, in which the mechanical transmission path is shown by double lines and the air flow is shown by single lines.

The system component 3 which is shown in FIG. 3 consists of at least one mechanical compressor 32 having a displacement effect, preferably a Roots supercharger or a half-roller compressor, provided with special sealing against penetrating oil; a low pressure chamber 31 on the suction side; a high pressure chamber 33 on the engine side; return ducts 34; and associated throttle valves D1, D2 and D3.

With this simple structure, supplemented by appropriate control mechanisms to operate the valves D1, D2 and D3, the system is technically functional. Thus, in principle, the components 2 and 3 act as a pneumatically adjustable transmission having minimum frictional losses and with partial recovery of the energy expended for the speed change. On the other hand, the combination can also be considered as a mechanism for the mechanical supercharging of the engine with the side-effect of a stepless change of the speed ratio upon the power transmission.

Which of the feature dominates depends primarily on the purpose it is used for or the situation of the driven vehicles. If for example the vehicle is to be accelerated at a constant rate of drive, more especially with maximum torque of the engine, then the angular velocity w(23) has to be increased by an amount Δw(23)>0. In accordance with the invention, the result is achieved with (21)=const. >) by means of simple reduction of the mass flow $$m = \frac{dm}{dt}$$

at the throttle valves D1 or D2. The return valve D3 in the return duct 34 is required primarily for idling and low load operation and may be closed during the acceleration of the vehicle. There is a maximum value m* for the air mass which can flow in through the valve D1, this value being determined in accordance with the theory of flow in fluid dynamics with a narrowing nozzle, this a maximum value being given by the equation:

$$m^* = S^* \cdot a_1,$$

wherein $a_1$ is the cross-section of the exit of the nozzle at D1 and S* is the maximum possible value of the flow density $S = \rho \cdot \underline{u}$, in which $\rho$ is the density of the air and $\underline{u}$ the velocity of air flow. In the present case S* is taken as a constant specific value for air. The reason why this is so is because:

$$S^* = \rho_o \cdot u_{max} \sqrt{\frac{k-1}{k+1}} \left(\frac{2}{k+1}\right)^{1/(k-1)}$$

$$\text{with } u_{max} = \sqrt{2c_p \cdot T_o}$$

the maximum inflow velocity, as well as $\rho_o$=density of the outside air, $T_o$=outside temperature, $C_p = C_v + R$ with $C_v$=the specific heat of the air, $K = C_p/C_v$ (See "Technische Stromungslehre", Teubner-Verlag 1977, pages 134–145). It follows therefrom that the maximum flow density m*, irrespective of the low pressure $P_1$, can be constrainedly varied within small limits by an amount $\Delta a_1$, i.e. by means of the throttle valve $D_1$.

The equations also apply analogously to the high pressure chamber 33, and additionally as a function of the variable density and temperature. By reducing the flow of air through the throttle valves D1 or D2, the output of compressed air from the compressor 32 is steadly reduced. This causes a low pressure $P_1$in the intake-side of the low pressure chamber 31 and a high pressure $P_2$ in the engine-side of the high pressure chamber 33, and in fact there acts on the rotary piston of the compressor 32 the pressure $$\Delta P = (P_o = P_1) + (P_2 - P_o) = P_2 - P_1.$$

In this respect, a compressive force $F_p = \Delta p \cdot A$(32) is developed on the cross-sectional surface area A of the compressor 32, and the angular velocity w(32) is reduced by amount equal to Δw(32).

The mechanical coupling of the rotary-piston shafts with the planetary gearing 2 consequently results in a reduction or limitation of the angular velocity w(32) of the sun wheel and by means of the planet wheels the drive is transmitted to the internally toothed wheel (23), depending on the valve position D1, D2, D3 with the power-take-off speed ranging from zero up to the transmission 1:1 or above.

The idling condition with the running engine in this simple version, as disclosed by the transmission system 2, is evident from the kinematics of the planetary gearing, as being a limiting case of the relation $q=w(22)/w(21)$, with $w(22)>w(21)>0$, and a reversing gear preferably a sun and planet wheel reversing gear having reversible locking devices, is provided to reverse the direction of the drive.

The qualitative relation is in this respect:

$$w(21) > 0 \rightarrow w(22) \rightarrow w(32) \rightarrow m(3);$$

$$\Delta a(3) \rightarrow \Delta m(3) \rightarrow \Delta p(3) \rightarrow Fp_{(3)} \rightarrow \Delta w(32);$$

$$\Delta w(32) \rightarrow \Delta w(22) \rightarrow \Delta w(23) > 0.$$

The engine works with permanent, but defined slippage and with slight friction. Therein lies its specific advantage. In each phase the full driving torque can be transmitted.

The thermics of the system remain, in this respect, at all times adjustable; the low pressure chamber 31 also serves inter alia as a cooling mechanism in respect to the temperature rise in the high pressure chamber 33 upon supercharging of the engine. This autonomous cooling is moreover advantageous with slight external cooling possibility, for example at low vehicle speed. In addition to this, both this low pressure and the high pressure of the air chamber 33 can be utilized for servo units outside the driving system by connection to connection points such as valves 21 and 22.

The boost pressure $P_3 \leqq P_2$ arises depending on the speed of the compressor 32 and depending on the setting of the valves D1, D2 and D3. To ascertain and to control the optimum opening of the individual valves depending on the travel situation does not present a technical problem, particularly with the help of a microprocessor and by development of an existing motor electronic system.

The efficiency of the driving system is adversely influenced by the heat flow between the air chambers 33 and 31, in particular by that part of the heat released in the high pressure chamber 33 which cannot be diverted to the low pressure chamber 31. By suitable dimensioning and arranging the pressure chambers 31 and 33, schematically shown adjacent one another in FIG. 3, more especially by a spatial penetration, for example with a number of pressure-resistant tubes integrated into the air flow, this part can be additionally restricted with constructional means.

The above construction is relatively cheap to manufacture. Since the output of the compressor does not necessarily have to be maximized, the rotational speed, overall size and clearance losses thereof are not critical. High-power vehicles can be operated independently thereof with an additional separated engine boosting.

To reinforce the driving torque, mechanical step-down stages, more especially planetary gear sets, can be connected, which are known in this function, for example with brakes and clutches.

Figure 4:
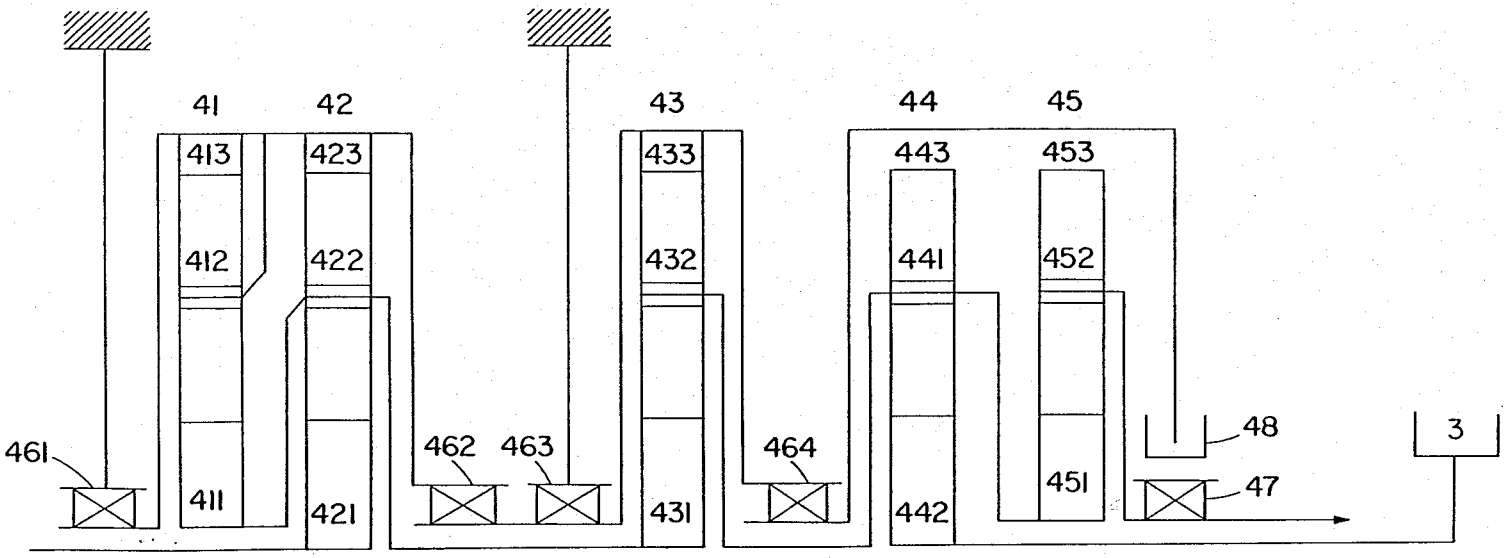
FIG. 4 shows the diagrammatic representation of a three-stage embodiment of a connectable torque amplification with superimposition of the stages and automatic phase change, as a development of the transmission system shown in FIG. 2, in interaction with the pneumatic mechanism shown FIG. 3, with drive at a sun wheel and power-take-off to a reversing gear (not shown) of the associated planet wheel.

For the drive system according to the invention, however, an arrangement of planetary gear set can be used which can, as development of the system component 2, advantageously be combined with the pneumatic mechanism 3, and which for the changing of the individual torque phases needs no switching elements such as brakes, clutches and the like and no separate switching control. Such an arrangement is realized substantially with one or more coaxially connected gear assemblies, the hollow wheel of which is supported on the housing by way of one free-wheel each, namely preferably in accordance with the diagram of FIG. 4.

The individual planet wheels therein are connected by way of the sun wheel 442 of the system-specific distributor gear 44 and by way of a hollow shaft to the pneumatic mechanism 3. The drive from the crankshaft of the engine is transmitted by way of the sun wheel 421 into the gear assembly 42, which is coupled to the gear assembly 41.

The hollow wheel 413 is prevented from reverse movement by the free-wheel 461, so that a drive, and in fact a reduced drive, is initially passed on only by way of the planet wheel carrier 422.

The manner of the coupling and the constructionally selectable design of the planetary gear sets 41 and 42 influence the degree of the step-down and the range of adjustment of the individual step-down phases. The wheel 422 transmits the correspondingly increased torque by way of the sun wheel 431 into a further gear assembly 43, the hollow wheel 433 of which likewise cannot yield to the driving moment, caused by the free-wheel 463. As a result, a further increased torque is transmitted to the planet carrier 441 of a distributor gear 44 and to the sun wheel 451 of an inner gear assembly 45. The power transmission takes place in idling, so long as the outer wheel 453 and the outer wheel 443 connected securely thereto can rotate in the reverse direction.

In an operating condition in which the motor speed is constant, upon the deceleration of the sun wheel 442 by the pneumatic mechanism 3, reverse rotation of the outer wheels 443, 453 is also restricted, with the result that an increased driving torque is transmitted by 441 to the power-take-off wheel 452 and the reversing gear (not shown). As soon as the angular velocity w(443) is equal to zero, the free-wheel 464 switches on, and the hollow wheel 433 is entrained. In this respect, the power-take-off speed is further increased.

Upon further deceleration of the sun wheel 442, synchronously with the acceleration of the vehicle, namely from the point at which $w(443)=w(423)>0$, by means of the then switched-in free-wheel 462 and by means of the planetary gear set 42, the hollow wheel 413 is released from the grip of the free-wheel 461 and is likewise driven.

In the case where $w(441)=w(442)$, and also $w(441)=w(443)$, and on account of the now switched-in effective connection of all outer wheels, thus also $w(421)=w(423)$ and so forth, for all the wheels; i.e. all the planetary gear sets will rotate as one solid shaft with a transmission ratio of 1:1.

In principle, as many or as few step-down stages as desired can be combined. The diagram of FIG. 4 can be modified to a two stage embodiment by omitting the planetary gear sets 41 and 42. In this respect, indeed in many cases more planetary gear sets are needed than with use of brakes and clutches, i.e. by alternative switching of the individual stages, but with the exception of the sun wheel 442 which drives the compressor 32, the speed of rotation of all the outer wheels, and especially the speed of rotation of the heaviest central wheel, and the planet carrier up to a transmission ratio is 1:1 is at all times less than the engine speed; the relative velocity of the individual wheels disappears in the course of the acceleration of the vehicle and the activation or deactivation of the individual step-down stages is effected autonomously, i.e. without external aids, being solely dependent upon the speed ratio between the crankshaft and the compressor and on the position of the throttle valves D1, D2 and D3.

The phasewise superimposition of the individual step-down stages provides, relative to the switching of alternative stages, in addition to this the advantage that an additional phase change, namely the activation or deactivation of a stage is possible, more especially when the speed of the vehicle is constant.

Irrespective of the torque amplification, another essential point needs to be taken into account for utilization in practice. The drive of the compressor 32 by way of a distributor gearing, for example 2 or 44, presupposes fundamentally the braking effect of the power-take-off, and it is also always present when the vehicle is to be driven. If, however, the vehicle is to be decelerated, more especially downhill, drive and take-off change sides for this purpose. In order nevertheless to be able to utilize the braking force of the engine in running operation and at a stand-still, the rotational movement of the gear has to be prevented with the aid of constructional means.

This is most simply achieved by means of a special free-wheel, e.g. 47 which prevents the forward running of the outer central gears and thus of the power-take-off shaft.

So that on the other hand the vehicle an also be moved with a transmission ratio greater than 1:1 or with the engine stationary, for example for towing away or push starting, this free-wheel is provided with a locking element, e.g. 48, which is releasable from the outside. A separate parking block is thus not necessary.

What is claimed:

1. A drive system for equipment driven by an internal combustion engine including means regulating fuel and air feeds thereto, comprising:

a pneumatic mechanism including:

(a) compressor means having an air intake and an outlet for optionally delivering compressed air to said engine;

(b) a high pressure chamber in fluid communication with said outlet;

(c) a low pressure chamber in fluid communication with said intake;

(d) duct means having a first valve means therein placing said high and low pressure chambers in fluid communication with one another;

(e) second valve means controlling the flow of air into said low pressure chamber;

(f) third valve means for controlling the flow of air out from said high pressure chamber;

transmission means for receiving drive power from said engine and having a power take-off shaft, said transmission means being adapted to divide said drive power into a first component transferrable to said power take-off shaft and a second component for operating said compressor means, said transmission means being in two-way drive relationship with said pneumatic mechanism;

and means controlling the operation of said first, second and third valve means, wherein said pneumatic mechanism delivers power to said transmission means proportional to the pressure difference between said high and low pressure chambers for stepless adjustment to the rotational speed of said power take-off shaft.

2. The drive system of claim 1 wherein said low and high pressure chambers are provided with connection points for pressure operated servo units.

3. The drive system of claim 1 wherein said valve means have linearly narrowing nozzles in the direction of air flow to maximize air flow density at the end of said nozzles.

4. The drive system of claim 1 wherein said transmission means further include at least one mechanical step-down stage to reinforce drive torque, said at least one step-down stage comprising coaxially mounted planetary gear sets.

5. The drive system of claim 4 including a plurality of step-down stages superimposed on one another phasewise, wherein each of said step-down stages is successively and respectively actuated and deactuated automatically in response to the speed ratio between a crank shaft of said internal combustion engine and said compressor means.

6. The drive system of claim 5 wherein said transmission means further include a free-wheel blocking the forward travel of said power take-off shaft.

7. The drive system of claim 6 further including an externally releasable blocking element for switching in said free-wheel.

8. A method of operating a drive system for an internal combustion engine coupled with a transmission for receiving drive power from said engine and a pneumatic mechanism in two-way driving communication with said transmission, said pneumatic mechanism including air compressor means, comprising the steps of:

supplying said engine with compressed air from said compressor means;

dividing said drive power in said transmission into a first component transferrable to a power take-off shaft of said transmission and a second component for operating said compressor means;

placing the intake of said compressor means in fluid communication with a low pressure chamber;

placing the outlet of said compressor means in fluid communication with a high pressure chamber;

placing said high and low pressure chambers in fluid communication with one another via duct means having a valve member therein;

controlling the flow of air into said low pressure chamber by means of second valve means, and controlling the flow of air out from said high pressure chamber by means of third valve means; and controlling said pneumatic mechanism by means of said first, second and third valve means whereby power from said pneumatic mechanism is delivered to said transmission means, said power being proportional to the pressure difference between said high and low pressure chambers to facilitate stepless adjustment to the rotational speed of said power take-off shaft.

9. The method of claim 8 wherein the mean temperature between said high pressure chamber and said low pressure chamber is maintained substantially constant.

10. The method of claim 9 wherein the mean temperature between said high and low pressure chambers is maintained substantially constant by controlling the flow of air through said first, second and third valve means.

11. The method of claim 10 wherein the temperature of said high pressure chamber and said low pressure chamber is substantially equalized by controlling the flow of air from said low pressure chamber to said high pressure chamber through said compressor means, and by the reverse flow of air from said high pressure chamber to said low pressure chamber via said duct means.

* * * * *